US007192451B2

(12) United States Patent
Bhatia et al.

(10) Patent No.: US 7,192,451 B2
(45) Date of Patent: Mar. 20, 2007

(54) FABRIC TREATMENT

(75) Inventors: Shameem Bhatia, Wirral (GB); Robert John Carswell, Wirral (GB); Paul Johnathon Evans, Dublin (IE); Paul Hugh Findlay, Wirral (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/537,184

(22) PCT Filed: Nov. 24, 2003

(86) PCT No.: PCT/EP03/13329

§ 371 (c)(1),
(2), (4) Date: Dec. 27, 2005

(87) PCT Pub. No.: WO2004/050981

PCT Pub. Date: Jun. 17, 2004

(65) Prior Publication Data

US 2006/0143834 A1 Jul. 6, 2006

(30) Foreign Application Priority Data

Dec. 5, 2002 (GB) ..... 0228358.8
Mar. 18, 2003 (GB) ..... 0306080.3

(51) Int. Cl.
*D06M 13/322* (2006.01)

(52) U.S. Cl. ..... 8/181; 8/115.51; 8/120; 8/189; 8/116.1; 510/513; 510/107

(58) Field of Classification Search ..... 8/115, 8/115.51, 116.1, 120, 181, 189; 510/513, 510/107
See application file for complete search history.

(56) References Cited

U.S. PATENT DOCUMENTS

| | | | | |
|---|---|---|---|---|
| 4,588,761 | A | 5/1986 | Thoma et al. | |
| 4,780,101 | A * | 10/1988 | Watanabe et al. | 8/192 |
| 5,676,964 | A * | 10/1997 | Della Valle et al. | 424/423 |
| 5,965,517 | A * | 10/1999 | Mooney | 510/516 |
| 2002/0155771 | A1 * | 10/2002 | Soane et al. | 442/79 |

FOREIGN PATENT DOCUMENTS

| | | |
|---|---|---|
| EP | 0 537 578 | 4/1993 |
| EP | 1 205 116 | 5/2002 |
| GB | 432 404 | 7/1935 |
| JP | 5593882 | 7/1980 |
| JP | 53 35098 | 12/1993 |
| JP | 6 346374 | 12/1994 |
| JP | 8 127972 | 5/1996 |
| JP | 1999 11 1374 | 5/1999 |
| JP | 2000 129573 | 5/2000 |
| WO | 98/04772 | 2/1998 |
| WO | 01/51496 | 7/2001 |

OTHER PUBLICATIONS

International Search Report, PCT/EP03/13329, mailed Apr. 8, 2004, 3 pp.
GB Search Report, GB 0228358.8, dated May 19, 2003, 1 p.
JP 7258968 A (Union Kagaku Kogyo). WPI Abstract Acc. No. 1995-380582, See Abstract.

* cited by examiner

*Primary Examiner*—Lorna M. Douyon
*Assistant Examiner*—Tri Nguyen
(74) *Attorney, Agent, or Firm*—Alan A. Bornstein

(57) ABSTRACT

A method of treating finished garments comprising cellulosic material so as to cause cross-linking, which comprises the step of treating fabrics with an effective amount of a blocked cross-linking agent for cellulose, the cross-linking agent being thermally activated.

6 Claims, No Drawings

FABRIC TREATMENT

TECHNICAL FIELD

The present invention relates to garment treatment compositions suitable for domestic use in a laundering process, and in particular to compositions which contain components which can cross-link with cellulose.

BACKGROUND OF THE INVENTION

Cellulose is a beta 1–4 linked polysaccharide and the principal component of cotton, which is a well-known material for the production of fabrics and in very widespread use. Cellulose is capable of cross-linking by hydrogen bonds which form between the cellulose chains.

The majority of garments purchased world-wide contain at least some cellulose fibres in the form of cotton or rayon and these suffer from the well-known problem that on exposure to water, such as during domestic laundering, fibre dimensions change and cause shrinking, shape change and wrinkling of the garments. It is believed that this is due to release and reformation of hydrogen bonds.

So-called 'durable press' treatments of fabrics are intended to overcome these difficulties. One of the most common methods of durable pressing uses a crosslinking agent to immobilise cellulose at a molecular level. Known cross-linking agents for whole cloth include formaldehyde, and urea-glyoxal resins. Other proposals include epichlorohydrins, vinyl sulphones, acrylo-amide and acrylo-acrylates. None of these proposed technologies have demonstrated any commercial viability for domestic on finished garments use to date.

A range of industrial processes for use in the manufacture of finished fabrics are known.

U.S. Pat. No. 4,588,761 discloses poly-urethane coating compositions for use with a transfer paper or other temporary support. These comprise an isocyanate which is preferably blocked. This is an industrial treatment process for fabric and is inherently unsuitable for use at home on finished garments.

JP 53035098 discloses a finishing process for treating woven or knitted cellulosic fabrics with a processing solution comprising a urethane prepolymer with blocked terminal isocyanate groups, a gloxal-amide type cross-linking agent and a bromo-fluorinated metal. The process is not suitable for domestic application to finished garments.

JP6346374 discloses finishing of fabric or a sewed product by a stepwise industrial process comprising treatment with a blocked isocyanate, heat treatment and subsequent use of a gas phase cross-linking agent. A similar process is disclosed in JP8127972.

JP 55093882 discloses a method for flocked fabric production which uses masked isocyanate. JP 9316781 discloses a finishing agent for use in the production of yarn, paper or films which comprises a blocked isocyanate. JP 11131374 discloses an industrial process for the product of water repellent fabric by treatment with a glyoxal-based resin crosslinking agent, an organo-fluorine compound and a isocyanate based cross-linking agent. Followed by heat treatment for 0.5–5 min. A similar process is disclosed in JP 2000129573.

An alternative proposal is to use poly-acids such as BTCA (butyl tetra carboxylic acid) or citric acid as crosslinking agents. These can esterify with the —OH groups of the cellulose to form a covalent cross-link. The covalent cross-link is not disrupted by water and this both prevents deformation of fabrics and assists return to a flat state. One of the difficulties with this approach is that a sodium hypophosphite catalyst is generally used to cause the esterification reaction to proceed and the treated articles require heat curing. Moreover, these poly-acid materials are highly water soluble and are difficult to deposit on fabrics.

A preferred durable press system suitable for domestic use should be a non-toxic, one component, catalyst-free system with low iron-cure times, have some affinity for the fabric surface and not cause fabric strength losses. It should also avoid the need for specialised equipment and the use of use of difficult materials such as vapour-phase formaldehyde.

BRIEF DESCRIPTION OF THE INVENTION

We have determined that excellent cross-linking benefits can be obtained by treating finished garments with a cellulose cross-linking agent that is thermally activated.

Accordingly, the present invention provides a method of treating finished garments comprising cellulosic material so as to cause cross-linking, which comprises the step of treating fabrics with an effective amount of a blocked cross-linking agent for cellulose, said cross-linking agent being thermally activated.

In the context of the present invention, the term 'thermally activated' is intended to mean that the cross-linking agent is 'blocked' to prevent reaction until the cross-linking agent is activated by the application of heat. In order to achieve cross-linking is preferable that at least two reactive sites of the cross-linking agents are blocked with a thermally labile blocking group.

Preferably the blocked cross-linking sites are selected such that, when activated, they are readily capable of reacting with hydroxy groups present in cellulose. More preferably the cross-linking reaction forms an 'ester' linkage, which in the context of the present invention includes linkages where the alpha carbon of the ester is replaced by a hetero-atom, preferably nitrogen. In the case of the alpha-carbon being so replaced the molecule is formally known as a carbamate.

Ideally, the reaction proceeds without the requirement for a catalyst. Catalysts can optionally be present. Suitable catalysts are selected depending on the particular blocking chemistry employed and, for example, include, pH modification agents and/or metal ions.

Preferably the cross-linking agent is bi-functional.

In one preferred embodiment of the invention the cross-linking agent is an at least bi-functional blocked polycarboxylic acid.

In another preferred embodiment of the invention the cross linking agent is an at least bi-functional blocked isocyanate.

By 'bi-functional' is meant that there are at least two blocked groups which can act as cross linking sites. Preferably, both of these are either blocked isocyanates or blocked carboxylic acids.

Preferably the blocked carboxylic acid is an ester with relatively weak ester bonds which can trans-esterify with cellulose. This is accomplished by forming the polyester between a poly-carboxylic acid and an alcohol (which term includes phenol) which is a good leaving group. The alcohols act as thermally labile 'blocking agents' for the carboxylic acid groups. Essentially the same result can be obtained by the use of carboxylic acid/imide linkages.

The present invention provides a method of treating finished garments comprising cellulosic materials so as to cause cross-linking which comprises the step of transesterifying the cellulosic material with an effective amount of an at least bi-functional blocked polycarboxylic acid.

Preferably said blocked polycarboxylic acid is blocked with an electron-withdrawing alcohol or imide.

The present invention further provides a method of treating finished garments comprising cellulosic materials so as to cause cross-linking which comprises the step of treating finished garments comprising cellulosic material with an effective amount of an at least bi-functional blocked isocyanate.

In the present invention the treatment is conducted as part of a domestic laundering operation applied to finished garments.

A further aspect of the present invention provides a composition for use in the methods described above.

Preferably, said composition will comprise a cross-linking agent which forms an ester linkage with the cellulose.

Preferably the cross-linking agent comprises either a blocked poly isocyanate or blocked poly carboxylic acid and which is thermally activated.

Preferably, the method of the invention comprises the step of curing the treated materials by heat treatment at a temperature of from 50 to 250 C, more preferably at a temperature of from 100–200 C.

More preferably, the method of the present invention further comprises the step of curing the treated materials by ironing or hot pressing. That a useful effect can be obtained by ironing after treatment is surprising.

Advantageously, the present method may be performed in the absence of vapour-phase formaldehyde and other components known from the prior art which are unsuitable for domestic use.

DETAILED DESCRIPTION OF THE INVENTION

As noted above the cellulose cross-linking agent can be a polycarboxylic acid or a blocked isocyanate. Preferred embodiments of each of these alternatives are discussed in further detail below.

In some embodiments the backbone of the cross-linking agent is polymeric in character, by which is meant that it comprises repeating structures. Typically, the backbone comprises a sufficiently long polymeric structure (preferably 2–12 carbon-carbon bond lengths) to fulfil its function as a bridging structure between the two or more reactive groups.

A. Blocked Polycarboxylicacids:

Polyesters suitable for use in the present invention comprise a polycarboxylic acid esterified with a 'leaving' group which is an alcohol or an imide. The polycarboxylic acid preferably has 2–6 carboxyl groups available for esterification. Typically each of the carboxyl groups will be esterified to produce a polyester.

Most preferably, the polycarboxylic acid has two carbonyl groups available for esterification and typically these are at opposite ends of an essentially linear polycarboxylic acid. In a preferred embodiment the polyester takes the form:

$$R_1O—CO\text{-}L\text{-}CO—OR_2$$

Where $R_1O$— and —$OR_2$ are the same or different alcohol residues, and —CO-L-CO— is the residue of the polycarboxylic acid. L is a linking group, which may be substituted, and generally comprises a 2–12 carbon backbone.

Polycarboxylic Acids:

Preferred polycarboxylic acids include one or more of malonic Acid, methylmalonic acid, ethylmalonic acid, butylmalonic acid, dimethylmalonic acid, diethylmalonic acid;

succinic acid, methylsuccinic acid, 2,2-dimethylsuccinic acid, 2-ethyl-2-methylsuccinic acid, 2,3-dimethylsuccinic acid, meso-2,3-dimethylsuccinic acid, glutaric acid, 2-methylglutaric acid, 3-methylglutaric acid, 2,2-dimethylglutaric acid, 3,3-dimethyl-glutaric acid, adipic acid, 3-methyladipic acid, 3-tert-butyladipic acid, pimelic acid, suberic acid, azelic acid, sebacic acid, 1,11-undecanecarboxylic acid, undecanedioic acid, 1,10-decanedicarboxylic acid, 1,12-dodecanedicarboxylic acid, hexadecanedioic acid, docosanedioic acid, tetracosanedioic acid, tricarballylic acid, 1,2,3,4-butanetetracarboxylic acid, itaconic acid, maleic acid, fumaric acid, citraconic acid, mesaconic acid, trans-glutaconic acid, trans-beta-hydromuconic acid, trans-traumatic acid, trans,trans-muconic acid, cis-aconitic acid, trans-aconitic acid, malic acid, citramalic acid, isopropylmalic acid, 3-hydroxy-3-methylglutaric acid, tartaric acid, mucic acid, citric acid, dihydroxyfumaric acid, diglycolic acid, 3,6-dioxaoctanedioic acid, 3,3'-thiodipropionic acid, 3,3'-dithiodipropionic acid, trans-DL-1,2-cyclopentanedicarboxylic acid, 3,3-tetramethyleneglutaric acid, camphoric acid, cyclohexylsuccinic acid, 1,1-cyclohexanediacetic acid, trans-1,2-cyclohexanedicarboxylic acid, 1,3-cyclohexanedicarboxylic aicd, 1,4-cyclohexanedicarboxylic acid, 1,3,5-cyclohexanetricarboxylic acid, Kemp's triacid, 1,2,3,4-cyclobutanetetracarboxylic acid, 1,2,3,4,5,6-cyclohexanehexacarboxylic acid 4-Carboxyphenoxyacetic acid, 1,4-phenylenediaectic acid, 1,4-phenylenedipropionic acid, 1,4-phenylenediacrylic acid, 2-Carboxybenzenepropanioc acid, 4,4'-oxybis(benzoic acid), phthalic acid, isophthalic acid, terephthalic acid, 1,2,3-benzenetricarboxylic acid, 1,3,5-benzenetricarboxylic acid, 1,2,4,5-benzenetetracarboxylic acid, mellitic acid, 2-methoxyisophthalic acid,
diphenic acid,
4,4'-biphenyldicarboxylic acid,
2,6-Napthalenedicarboxylic acid,
3-carboxy-1,4-dimethyl-2-pyroleacetic acid, Oligomers (and co-oligomers) of unsaturated carboxylic acids can be used. Suitable materials include oligomers of acrylic acid, methacrylic acid, crotonic acid, vinylacetic acid, 4-pentenoic acid, and/or maleic acid.

The acid can comprise a heteroatom. Nitrogen is a preferred heteroatom. Suitable N-containing acids include:

iminodiacetic acid,
3-aminophthalic acid, 2-aminoterephthalic acid, 5-aminoisophthalic acid,
ethylenediamine-N,N'-diacetic acid,
methyliminodiacetic acid,
nitrilotriacetic acid,
ethylenediaminetetraacetic acid,
1,6-diaminohexane-N,N,N',N'-tetraacetic acid,
trans-1,2-diaminocyclohexane-N,N,N',N',-tetraacetic acid,
triethylenetetraminehexaacetic acid,
1,3-diamino-2-hydroxypropane-N,N,N',N'-tetraacetic acid,
ethylenebis(oxyethylenenitrilo)tetraacetic acid,
diethylenetriaminepentaacetic acid,
aspartic acid,
glutamic acid,
2-methylglutamic acid,
2-aminoadipic acid,
3-aminoadipic acid,
2,6-diaminopimelic acid,
cystine
N-benzyliminodiacetic acid,
N-(2-carboxyphenyl)glycine,
2,2'-(ethylenedioxy)dianiline-N,N,N',N'-tetraacetic acid.
porphobilinogen,
4,5-imidazoledicarboxylic acid,
2,2'-bipyridine-4,4'-dicarboxylic acid,
3,4-pyridinedicarboxylic acid, 2,5-pyridinedicarboxylic acid, 3,5-pyridinedicarboxylic acid, 2,6-pyridinedicarboxylic acid,
6-methyl-2,3-pyridinedicarboxylic acid,
2,6-dimethyl-3,5-pyridinedicarboxylic acid In the case where a nitrogen is present, this may be quaternerised with an appropriate quaternerising agent.

Known quaternerising agents include $CH_3Cl$, $CH_3I$, and $(CH_3)_2SO_4$.

Alcohols:

The alcohol may have a linear, branched or ring structure.

Preferred alcohols comprise 5- or 6-membered rings which have electron-withdrawing groups in the ortho- and para-positions relative to the alcoholic hydrogen. Examples of such preferred alcohols include N-hydroxysuccinimide and hydroxybenzotriazole. In addition, the alcohol may be in the enol form of a ketone. As noted above, and for the avoidance of doubt, phenols are considered alcohols for the purpose of this specification.

Suitable electron withdrawing substituents on the ring include one or more of: $NO_2$, CN, $CO_2H$, $CO_2R$, CONHR, $CONR_2$, CHO, COR, $SO_2R$, $SO_2OR$, $SO_2OAr$, NO, Ar, $NR_3^{\oplus}$, $SR_2^{\oplus}$, $NH_3^{\oplus}$, F, Cl, Br, I, OAr, SH, SR, OH, OR, $CH{=}CR_2$. The electron withdrawal can be due to either inductive or resonance effects.

Phenol derivatives with at least one electron-withdrawing substituent are preferred.

Preferred phenol derivatives include:

Vanillin,
Ethyl vanillin,
Eugenol,
isoeuginol,
salicylic acid, ethyl salicylate,
4-cyanophenol,
hydroxyacetophenone,
trichlorophenol,
2,6-dimethoxyphenol,
4-aminophenol (and quaternerised salt),
dimethylaminophenol (and quaternerised salt),
chlorophenol, bromophenol, iodophenol, fluorophenol, dichlorophenol, dibromophenol, diiodophenol, difluorophenol,
hydroxythiophenol,
aminocresol,
4-amino-2,5-dimethylphenol,
6-amino-2,4-dichloro-3-methylphenol,
nitrophenol, dinitrophenol,
hydroxypropiophenone,
2'-hydroxy-5'-methylacetophenone,
5'-chloro-2'-hydroxyacetophenone,
acetovanillone,
4-hydroxybenzaldehyde,
o-vanillin,
4-hydroxy-3-methylbenzaldehyde,
2-chloro-4-hydroxybenzaldehyde,
2-hydroxy-5-methoxybenzaldehyde,
3-ethoxy-4-hydroxybenzaldehyde,
5-nitrovanillin,
3-methoxy-5-nitrosalicyaldehyde,
4-hydroxybenzoic acid,
methylsalicylic acid,
chlorosalicylic acid,
methoxysalicylic acid,
aminosalicylic acid,
methylsalicylic acid,
formylsalicylic acid,
hydroxyisophthalic acid,
methyl hydroxybenzoate,
ethyl hydroxybenzoate,
propyl hydroxybenzoate,
methyl 5-methylsalicylate,
ethyl 5-methylsalicylate,
hydroxybenzamide,
5-chloro-2-hydroxybenzamide,
5-acetylsalicylamide,
2-amino-4-(ethylsulfonyl)phenol Particularly preferred alcohols include trichlorophenol, isoeuginol, vanillin, 4-cyanophenol, ethyl salicylate, 2,6-dimethoxy phenol, 4-aminophenol and dimethylamino phenol. As noted above, imides can also be used as the 'alcohol'.

A preferred imide material is N-hydroxysuccinimide.

The alcohol leaving group can have functional properties which give it some utility after the transesterification reaction. One such property is that of a perceptible odour. For example, a notable odour of cloves is obtained with weak isoeuginol esters upon the application of heat (i.e. on ironing). This can act as a useful cue to the user that the reaction is proceeding.

Preferred polyesters include the trichlorophenol diester of succinic acid, the trichlorophenol diester of BTCA, the N-hydroxysuccinimide diester of succinic acid, the isoeugenol diester of succinic acid, and the vanillin diester of succinic acid.

The polyester will typically only have one type of alcohol present, although it is possible to envisage 'mixed' esters in which two or more, different types of alcohol are present.

It is particularly preferred that the polyester has a molecular weight below 1500 Dalton. It is believed that the cellulosic materials will stiffen if larger molecular weight materials are used.

While the polyester can be applied from a non-aqueous solvent (such as THF) it is preferable to apply the material from a wholly or partly aqueous solvent.

B. Blocked Polyisocyanates:

In another class of embodiments of the invention the treatment agent is a blocked isocyanate.

Blocked isocyanate is described at length and defined in 'Progress in Organic Coatings' 36 (1999) 148–172.

Preferably, but not exclusively, the blocked isocyanate is chemically blocked. Such molecules include materials which are derived from isocyanate compounds by reaction with an active hydrogen compound. However, it is also known to produce blocked isocyanate via other routes not involving the reaction of an isocyanate, these are still known in the art as blocked isocyanate. Similarly, while cross-linking most reactions of the blocked isocyanate will generate an isocyanate as an intermediate, reaction schemes have been suggested in which the blocked isocyanate reacts without the formation of such an intermediate. It is also known that isocyanate can form thermally unstable dimers or higher polymeric forms, generally known as 'uretdiones' these are also considered to be examples of blocked isocyanate for the purposes of the present invention.

As suitable polycarboxylic acids and 'blocking' alcohols were described above, so suitable polyisocyanates and blocking groups are described below.

Polyisocyanates:

1,4-Diisocyanatobutane
1,6-Diisocyanatohexane
1,8-Diisocyanatooctane
1,10-Diisocyanatodecane
1,12-Diisocyanatododecane
Tetradecamethylenediisocyanate
Trimethylhexanediisocyanate
Tetramethylhexanediisocyanate
trans-11,4-cyclohexylene diisocyanate
Isophorone diisocyanate
1,3-Bis(isocyanatomethyl)cyclohexane
4,4'-methylenebis(cyclohexyl isocyanate)
Trimethylolpropane triisocyanate
1-isocyanato-2,4-bis[(4-isocyanatocyclohexyl)methyl]-cyclohexane
α,4-Tolylene diisocyanate
m-xylene diisocyanate
Toluene 2,4-diisocyanate
Toluene 2,5-diisocyanate
1,3-Bis(1-isocyanato-1-methylethyl)benzene
1,3-Phenylene diisocyanate
1,4-Phenylene diisocyanate
2,6-Tolylene diisocyanate
4,4'-oxybis(phenyl isocyanate)
Naphthylene-1,5-diisocyanate
Triphenyl methane-4,4',4"-triisocyanate
2,4-diisocyanato-1-(4-isocyanatophenoxy)-benzene
1,3,5-triisocyanato-2-methyl-benzene
Diphenylmethane-2,4,4',-triisocyanate Also envisaged as suitable are biuret-isocyanurate- or urethane-group-containing modification products of the above mentioned simple polyisocyanates, for example tris-(6-isocyanatohexyl)-biuret and its higher homologs; polyisocyanates containing isocyanurate groups obtainable by the trimerisation of aliphatic and/or aromatic diisocyanates such as hexamethylene diisocyanate, isophorone diisocyanate, especially tri-(6-isocyanatohexyl)-isocyanurate Polyisocyanates formed by the reaction of an excess of diisocyanate with polyhydric alcohols followed by the removal of unreacted diisocyanate excess by distillation.

Examples of simple polyhydric alcohols include:

Glycerol
1,2-dihydroxypropane
Trimethylol propane
Pentaerythritol
Ethylene glycol
Diethyleneglycol
Triethyleneglycol
Tetraethyleneglycol
Pentaethyleneglycol
Hexaethylene glycol
Polyethyleneglycol
Polypropyleneglycol
Dipentaerythritol
Triethanolamine (which can be optionally quaternerised)

The diisocyanates can also be reacted with polyols containing anionic groups such as carboxylic acids, sulphone acids and phosphoric acids, and especially hydroxyacids followed by removal of excess unreacted diisocyanate by distillation in a similar manner. Suitable hydroxyacids include:

2,2-bis(hydroxymethyl)acetic acid
2,2-bis(hydroxymethyl)propionic acid
2,2-bis(hydroxymethyl)butionic acid
2,2,2-tris(hydroxymethyl)acetic acid
Tartaric acid The acid groups can optionally be partially or completely neutralised to make the iscoyanate-containing molecule water soluble or water dispersible.

Polyisocyanates can also be formed by reaction of diisocyanates with polyamines followed by removal of excess unreacted diisocyanate by distillation.

Examples of suitable polyamines include:

Diethylenetriamine
N-(2-aminoethyl)-1,3-propanediamine
3,3'-diamino-N-methyldipropylamine
N-(3-aminopropyl)-1,3-propanediamine
Spermidine
Bis(hexamethylene)triamine
2,2'-(ethylenedioxy)bis(ethylamine)
4,7,10-trioxa-1,13-tridecanediamine
Glycerol tris(poly(propylene glycol)amine terminated) ether
Chitosan Polyisocyanates formed by the conversion from polyamines, for example by treatment with phosgene are also included.

Hexamethylene diisocyanate is a particularly preferred isocyanate for use in the present invention.

Polyisocyanate Blocking Agents:

These are analogous to the thermally-labile alcohol blocking agents used for the esters and described above. As in the case of the preferred materials described for blocking esters the blocking agents for the isocyanates can also be phenols. As noted above the isocyanates generally react with cellulose to form carbamates, which are considered examples of the more general class of esters. It is believed that some isocyanates, will however react to form 'true' esters.

Preferred phenols again have electron withdrawing substituents in the ortho and/or para position relative to the alcoholic proton.

Oximes, (an oxime is formed by the reaction of hydroxylamine with a carbonyl compound) can be used to block isocyanates. Examples of suitable ketones that form oximes by reaction with hydroxylamine include:

Tetramethylcyclobutanedione
Methyl n-amyl ketone
Methyl isoamyl ketone
Methyl 3-ethylheptyl ketone
Methyl 2,4-dimethylpentyl ketone
Methyl ethyl ketone
Cyclohexanone
Methyl isopropyl ketone
Methyl isopropyl ketone
Methyl isobutyl ketone
Diisobutyl ketone
Methyl t-butyl ketone
Diisopropyl ketone
2,2,6,6-Tetramethylcyclohexanone Suitable non-phenol alcohol blocking agents include:

Mono-ethers of ethylene glycol such as 2-ethoxyethyl alcohol, 2-ethoxyethoxyethyl alcohol, 2-ethylhexyloxyethyl alcohol, 2-butoxyethyl alcohol, and 2-butoxyethoxyethyl alcohol N,N-Glycol amides such as N,N-dibutylglycolamide N-hydroxysuccinimide Suitable amides and imides blocking agents include:

Acetanilide
N-methylacetamide
Caprolactam
2-pyrrolidone
Succinimide

Suitable imidazole and amidine blocking agents include:

2-ethyl-4-methylimidazole
2-methylimidazole
1,4,5,6-tetrahydropyrimidine
guanidine
2,4-dimethylimidazoline
4-methylimidazoline
2-phenylimidazoline
4-methyl-2-phenylimidazoline Suitable Pyrazole and triazole blocking agents include:

pyrazole
3-methylpyrazole
3,5-dimethylpyrazole
1,2,4-triazole
Benzotriazole

Secondary and especially hindered amines can be used to block isocyanates.

Suitable active methylene blocking agents include:

diethyl malonate
t-butyl methyl malonate
Meldrum's acid (isopropylidene malonate)
Ethyl acetoacetate
t-butyl acetoacetate Particularly preferred blocking agents are Meldrum's Acid, Phenol, 4-Nitrophenol, 4-Methoxyphenol, and/or Methyl Salicylate. The most preferred blocking agents are diethyl malonate, succinimide and sodium bisulphite.

Both the isocyanates and the carboxylic acids described above can be mono-blocked by reaction of only one of the characteristic reactive groups by a suitable blocking agent. The remaining free reactive group(s) can then be reacted with a bi-functional further linking group (such as a polyol or polyamine) to form blocked structures which (taking the mono-blocked acids and a diol as an example) have the form:

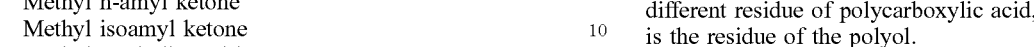

$$R_1O—CO\text{-}L_1\text{-}CO—OMO—CO\text{-}L_2\text{-}CO—OR_2$$

Where:

$R_1O$— and —$OR_2$ are the same or different alcohol residues, —CO-$L_1$-CO— and —CO-L2-CO— are the same or different residue of polycarboxylic acid, and, —OMO— is the residue of the polyol.

Similar structures can be prepared from the isocyanates.

Methods of forming mono-blocked isocyanates include blocking of diisocyanates where each isocyanate group has a different reactivity thus one or more groups become preferentially blocked. Alternatively, the blocking agent can be added to a large excess of diisocyanate and the unreacted diisocyanate removed by distillation upon completion of blocking. Similar considerations apply to esters.

Reaction of the mono-blocked cross-linking agent with either a polyol or polyamine can involve either reaction with all the available hydroxy or amine groups to give a 100% modified polyol or polyamine.

By controlling the amount of mono-blocked cross-linking added, structures with both modified and unmodified hydroxy and amine groups can be formed. Such structures are capable of self-crosslinking upon removal of the blocking groups.

Suitable polyols include those found among the alcohols described previously as being suitable for blocking isocyanates or carboxylic acids.

Particularly preferred polyols are:

Sugars such as sorbitol, mannitol, xylose, fructose, galactose, mannose, glucose, altrose, lactose, cellobiose, sucrose, Oligo and polysaccharides, preferentially β-1,4-linked oligo- and polysaccharides.

Particularly preferred are polyols are cellulose and its derivatives, or other polysaccharides which have the ability to recognise cellulose, example of which include locus bean gum and guar gum.

Suitable polyamines include:

Diethylenetriamine
N-(2-aminoethyl)-1,3-propanediamine
3,3'-diamino-N-methyldipropylamine
N-(3-aminopropyl)-1,3-propanediamine
Spermidine
Bis(hexamethylene)triamine
2,2'-(ethylenedioxy)bis(ethylamine)
4,7,10-trioxa-1,13-tridecanediamine
Glycerol tris(poly(propylene glycol)amine terminated) ether
Chitosan Optionally, unreacted amino groups can be rendered cationic by modification with quaternerising agents such as methyl iodide, dimethyl sulphate and the like. Such cationic modification improves the substantivity of the materials.

By use of a secondary linking group 'M' which can recognise (as in the case of polysaccharides) or otherwise bind (as in the case of the cationics) to a cellulosic substrate the efficiency of deposition of the cross-linking agents can be significantly improved.

Carriers and Product Form:

Compositions of the present invention are preferably formulated into fabric care compositions comprising a solution, dispersion or emulsion comprising a cross-linking agent.

The compositions of the invention will generally comprise a textile compatible carrier.

In the context of the present invention the term "textile compatible carrier" includes a component which can assist in the interaction of the cellulose cross-liking agent with a textile. The carrier can be a simply a solvent for the cross-linking agent, although the carrier can also provide benefits in addition to those provided by the cross-linking agent e.g. softening, cleaning etc. Preferably, the carrier is a detergent-active compound or a textile softener or conditioning compound or a detergent.

If the composition is to be used in a laundry process as part of a conventional fabric treatment product, such as a rinse conditioner or main wash product, it is preferable if the level of cross-linking agent is from 0.01% to 10%, more preferably 0.05% to 7.5%, most preferably 0.1 to 5 wt % of the total composition.

If, however, the composition is to be used in a laundry process as a product to specifically treat the fabric to reduce creasing, higher levels of cross-linking agent can be used. Preferred amounts are from 0.01% to 15%, more preferably 0.05% to 10%, for example from 0.1 to 7.5 wt % of the total composition.

If the composition is to be used in a spray product it is preferred that the level of cross-linking agent is from 0.5 to 20 wt %, preferably 1 to 20 wt % of the total composition.

As noted above, the method of the invention generally comprises the step of applying a composition of the cross-linking agent to garments and curing the composition, preferably by ironing. The composition may be applied to the fabric by conventional methods such as dipping, spraying or soaking, for example.

The fabric care composition of the invention preferably comprises a solution, dispersion or emulsion comprising a cross-linking agent and a textile compatible carrier. The textile compatible carrier facilitates contact between the fabric and the ingredients of the composition. The textile compatible carrier may be water or a surfactant. However, when it is water, it is preferred that a perfume is present.

In one particularly preferred embodiment, the composition may be provided in a form suitable for spraying onto a fabric. The fabric may then be dried, e.g. in a tumble dryer, and then ironed to cure the composition.

If this is the case, it is preferred that the polycarboxylic acid or derivative thereof is present at a level from 0.5 to 20 wt %, preferably 0.5 to 10 wt %, of the total composition. If the product is to be used in a spray on product it is also beneficial if wetting agents are also present such as alcohol ethoxylates for example, Synperonic A7.

For a spray on formulation anionic surfactants may be present.

Suitable spray dispensing devices are disclosed in WO 96/15310 (Procter & Gamble) and are incorporated herein by reference. Alternatively, the composition may be applied through the irons water tank, a separate reservoir or a spray cartridge in an iron, as described in EP1201816 and WO 99/27176.

Spray products may contain water and/or other solvents as a carrier molecule.

It is particularly advantageous, and surprising, that the composition can be cured by ironing, even under domestic conditions. Moreover, a steam iron can be used, which is desirable to aid wrinkle removal, with no deleterious effects on the curing process.

A further advantage of the method of the invention is that, when the composition is applied as a spray, one application is sufficient to obtain benefits after subsequent washes.

In a washing process, as part of a conventional textile washing product, such as a detergent composition, the textile-compatible carrier will typically be a detergent-active compound. Whereas, if the textile treatment product is a rinse conditioner, the textile-compatible carrier will be a textile softening and/or conditioning compound. These are described in further detail below.

The cross-linking agent can be used to treat the textile in the wash cycle of a laundering process. The cross-linking agent can also be used in the rinse cycle, or, preferably applied prior to or during ironing and/or pressing.

The composition of the invention may be in the form of a liquid, solid (e.g. powder or tablet), a gel or paste, spray, stick or a foam or mousse. Examples include a soaking product, a rinse treatment (e.g. conditioner or finisher) or a main-wash product. Spray products are particularly suited to application as part of an ironing or pressing process.

Liquid compositions may also include an agent which produces a pearlescent appearance, e.g. an organic pearlising compound such as ethylene glycol distearate, or inorganic pearlising pigments such as microfine mica or titanium dioxide ($TiO_2$) coated mica. Liquid compositions may be in the form of emulsions or emulsion precursors thereof.

Detergent Active Compounds:

If the composition of the present invention is itself in the form of a detergent composition, the textile-compatible carrier may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred textile-compatible carriers that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are independently hydrocarbyl chains of $C_1$–$C_{22}$ length, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt % e.g. 0.5–55 wt %, such as 5–50 wt %.

Preferably, the quantity of anionic surfactant (when present) is in the range of from 1 to 50% by weight of the total composition. More preferably, the quantity of anionic surfactant is in the range of from 3 to 35% by weight, e.g. 5 to 30% by weight.

Preferably, the quantity of nonionic surfactant when present is in the range of from 2 to 25% by weight, more preferably from 5 to 20% by weight.

Amphoteric surfactants may also be used, for example amine oxides or betaines.

Builders:

The compositions may suitably contain from 10 to 70%, preferably from 15 to 70% by weight, of detergency builder. Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{–}1.5M_2O.Al_2O_3.0.8\text{–}6SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

Alternatively, or additionally to the aluminosilicate builders, phosphate builders may be used.

Textile Softening and/or Conditioner Compounds:

If the composition of the present invention is in the form of a textile conditioner composition, the textile-compatible carrier will be a textile softening and/or conditioning compound (hereinafter referred to as "textile softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the textile in the tumble dryer if used in a suitable form. Thus, another product form is a composition (for example, a paste) suitable for coating onto, and delivery from, a substrate e.g. a flexible sheet or sponge or a suitable dispenser during a tumble dryer cycle.

Suitable cationic textile softening compounds are substantially water-insoluble quaternary ammonium materials comprising a single alkyl or alkenyl long chain having an average chain length greater than or equal to $C_{20}$. More preferably, softening compounds comprise a polar head group and two alkyl or alkenyl chains having an average chain length greater than or equal to $C_{14}$. Preferably the textile softening compounds have two, long-chain, alkyl or alkenyl chains each having an average chain length greater than or equal to $C_{16}$.

Most preferably at least 50% of the long chain alkyl or alkenyl groups have a chain length of $C_{18}$ or above. It is preferred if the long chain alkyl or alkenyl groups of the textile softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The textile softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble textile softening compounds are defined as textile softening compounds having a solubility of less than $1\times10^{-3}$ wt % in demineralised water at 20° C. Preferably the textile softening compounds have a solubility of less than $1\times10^{-4}$ wt %, more preferably less than $1\times10^{-8}$ to $1\times10^{-6}$ wt %.

Especially preferred are cationic textile softening compounds that are water-insoluble quaternary ammonium materials having two $C_{12\text{-}22}$ alkyl or alkenyl groups connected to the molecule via at least one ester link, preferably two ester links. Di(tallowoxyloxyethyl) dimethyl ammonium chloride and/or its hardened tallow analogue are especially preferred of the compounds of this type. Other preferred materials include 1,2-bis(hardened tallowoyloxy)-3-trimethylammonium propane chloride. Their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic textile softeners, as described in GB 2 039 556B (Unilever).

The compositions may comprise a cationic textile softening compound and an oil, for example as disclosed in EP-A-0829531.

The compositions may alternatively or additionally contain nonionic textile softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

Other Components

Compositions according to the invention may comprise soil release polymers such as block copolymers of polyethylene oxide and terephthalate.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, fluorescers, colourants, hydrotropes, antifoaming agents, enzymes, optical brightening agents, and opacifiers.

Suitable bleaches include peroxygen bleaches. Inorganic peroxygen bleaching agents, such as perborates and percarbonates are preferably combined with bleach activators. Where inorganic peroxygen bleaching agents are present the nonanoyloxybenzene sulphonate (NOBS) and tetra-acetyl ethylene diamine (TAED) activators are typical and preferred.

Suitable enzymes include proteases, amylases, lipases, cellulases, peroxidases and mixtures thereof.

In addition, compositions may comprise one or more of anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. The lists of optional components are not intended to be exhaustive.

In order that the invention may be further and better understood it will be described below with reference to several non-limiting examples.

EXAMPLES

Synthesis Examples

Example 1

Synthesis of 2,4,6-Trichlorophenol Diester of Butanetetracarboxylic Acid

Butane tetracarboxylic acid (BTCA) (20.84 g, 0.089 mol) and 2,4,6-trichlorophenol (35.80 g, 0.18 mol) were weighed into a RB flask (250 $cm^3$). Nitrogen was flushed through the flask for 15 minutes, then distilled THF (150 $cm^3$) was added. After stirring under nitrogen for 30 minutes, diisopropyl-carbodiimide (29.0 $cm^3$, 0.18 mol) was added dropwise over 20 minutes. The reaction was allowed to stir overnight under nitrogen. The mixture was filtered, washed with THF then stirred for one hour to ensure that formation of precipitate was complete. The solvent was removed to afford the crude product. This was washed several times with dichoromethane to yield the product upon removal of the solvent from the filtrate.

Example 2

Synthesis of 2,4,5-Trichlorophenol Diester of Succinic Acid

Succinic acid (1.5 g, 0.013 mol) was dissolved in DMSO (50 $cm^3$). 1,1'-Carbonyldiimidazole (5.0 g, 0.03 mol) was added and the mixture stirred for 30 mins at room temperature. 2,4,5-Trichlorophenol (5.05 g, 0.026 mol) was then added and the mixture stirred at room temperature overnight. The mixture was added to water, filtered, then washed with water followed by diethyl ether to yield a white solid (2.03 g, 33%) $\delta_H$ (500 MHz; $CDCl_3$) 3.07 (4H, s, $CH_2$—$CH_2$—C(O)—O—) and 7.55 & 7.29 (4H, s, Ph)

Example 3

Synthesis of N-Hydroxysuccinimide Diester of Succinic Acid

Succinic acid (2.0 g, 0.017 mol) was dissolved in THF (50 $cm^3$) 1,1'-Carbonyldiimidazole (5.49 g, 0.034 mol) was added and the mixture stirred for 30 mins at room temperature. N-Hydroxysuccinimide (3.89 g, 0.034 mol) was added and the mixture stirred at room temperature overnight. The mixture was added to water, filtered, then washed with water then diethyl ether to yield a white solid (2.0 g, 38%) $\delta_H$ (500 MHz; $CDCl_3$) 2.59 (8H, s, $CH_2$—$CH_2$—CO—N—) and 2.89 (4H, s, $CH_2$—$CH_2$—C(O)—O—)

Example 4

Synthesis of Vanillin Diester of Succinic Acid (1) Organic Solvent Method:

Vanillin (9.82 g, 64.5 mMols) was dissolved in anhydrous THF (100 $cm^3$) with stirring at room temperature and under nitrogen. Anhydrous sodium carbonate (8.2 g, 77.4 mMols, 1.2 equiv) was then added and stirring was continued for 30 mins. Succinyl chloride (5 g, 32.25 mMols, 0.5 equiv) was then added dropwise to the slurry over 20 mins, the mixture was then stirred in the dark for a further 18 hours. The mixture was then filtered and the solvent removed from the filtrate under reduced pressure to give an off-white solid. The crude product was then recrystallised from IPA to give a white solid (2.7 g, 24%). $\delta_H$ (500 MHz; $CDCl_3$) 3.08 (2H, s, —$CH_2$—C(O)—O—), 3.89 (3H, s, —$OCH_3$), 7.27–7.50 (3H, m, Ph) and 9.95 (1H, s, —CHO).

(2) Schotten-Baumann Method:

Sodium Hydroxide (1.3 g, 32.5 mmols) was dissolved in distilled water (100 $cm^3$). To this solution vanillin (4.91 g, 32.5 mmols) was added and the solution was stirred to give a light yellow solution. The solution was then cooled to 0° C. prior to the dropwise addition of succinyl chloride (2.5 g, 16.25 mmols). The mixture was then allowed to warm to room temperature and stirring was continued for a further 10 mins to give a light yellow precipitate. The mixture was then poured into water (200 $cm^3$) and stirred at room temperature for 30 mins. The solution was filtered and the solid material retained. This crude product was then recrystallised to give a white solid (0.84 g, 13%).

Example 5

Synthesis of 4-Cyanophenol Diester of Succinic Acid

4-Cyanophenol (7.7 g, 64.5 mMols) was dissolved in anhydrous THF (100 $cm^3$) with stirring at room temperature and under nitrogen. Anhydrous sodium carbonate (8.2 g, 77.4 mMols, 1.2 equivalents) was then added and stirring was continued for a further 10 mins. Succinyl chloride was then added dropwise over 20 mins and the mixture was stirred under nitrogen for a further 18 hours in the dark. The grey slurry was filtered and the solvent was removed from the filtrate under reduced pressure to give a grey solid. This crude material was then recrystallised from IPA to give a off-white solid (3.7 g, 36%). $\delta_H$ (500 MHz; $CDCl_3$) 3.03 (2H, s, —$CH_2$—C(O)—O—), 7.24 (2 H, d, J 8, Ph). & 7.69 (2 H, d, J 8.5, Ph).

Example 6

Synthesis of Isoeuginol Diester of Succinic Acid

Isoeuginaol (25 g, 0.15 mol) was dissolved in THF (100 $cm^3$). Sodium carbonate (16.14 g, 0.15 mol) was added and the mixture stirred at room temperature. Succinyl chloride (11.8 g, 0.075 mol) was added to the stirred mixture over 20 minutes, and the mixture stirred for a further 90 minutes. The reaction mixture was then heated to 50° C. for 60 mins, then stirred at room temperature overnight. The mixture was filtered and the solvent removed under reduced pressure to give a dark coloured oil which solidified upon standing. This crude material was recrystallised from ethyl acetate and diethyl ether to give an off-white solid (4.67 g, 8%) $\delta_H$ (500 MHz; $CDCl_3$) 1.86 (6H, d, —$CN_3$—CH═CH—), 3.80 (6H, s, Ph $CH_3$), 6.34–6.14 (4H, m, CH═$CHCH_3$) and 6.70–6.88 (6H, m, Ph).

Example 7

Synthesis of Hexamethylene Diisocyanate Blocked with Meldrum's Acid

Synthesis:

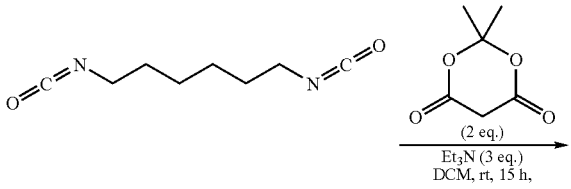

-continued

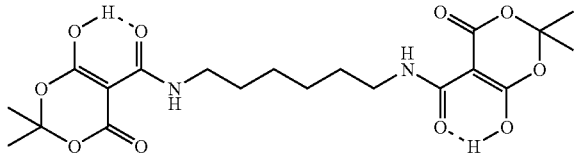

At room temperature a mixture of diisocyanatohexane (5.0 mL, 30.92 mmol, 1 eq.) and Meldrum's acid (9.36 g, 64.92 mmol, 2.1 eq.) in dichloromethane (100 mL) was treated with triethylamine (12.9 mL, 92.75 mmol, 3.0 eq.) in a dropwise fashion. Stirring was continued for 15 hours. TLC analysis (EtOAc) indicated no remaining Meldrum's acid. Silica (ca. 25 g) was added and the solvent was removed in vacuo. Purification by flash column chromatography afforded the diamide (7.33 g, 55%) as a colourless solid. $R_f$=0.1 (EtOAc); $\delta_H$ (400 MHz, $CDCl_3$) 1.42–1.46 (4H, m, $CH_2$), 1.59–1.68 (4H, m, $CH_2$), 1.69–1.74 (12H, s(br), $CH_3$), 3.42 (4H, q, J 6.5 Hz, $CH_2$), 9.25–9.34 (2H, s(br), NH), 14.95–15.0 (2H, s(br), OH); $\delta_C$ (100 MHz, $CDCl_3$) 26.2 ($CH_2$), 26.2 ($CH_3$), 28.9, 40.3 ($CH_2$), 72.8 (C-quat), 104.6, 164.2 (C═), 170.25, 170.3 (CO); m/z ($ES^+$) 477 ($M-H^+2Na^+$, 100%). Found C, 51.49; H, 6.05; N, 5.98; $C_{18}H_{28}N_2O_{10}$ requires C, 50.00; H, 6.48; N, 6.48.

Example 8

Synthesis of Hexamethylene Diisocyanate Blocked with Phenol

Synthesis:

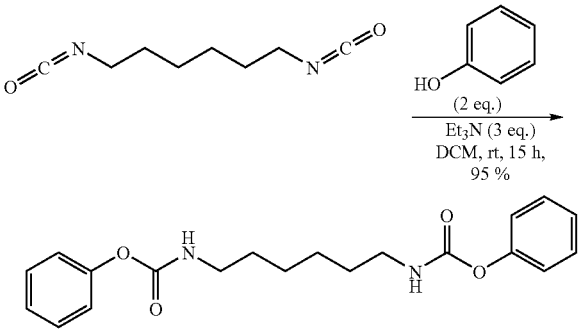

Diisocyanatohexane (1.0 mL, 6.18 mmol, 1 eq.) and phenol (1.26 g, 13.39 mmol, 2.1 eq.) in dichloromethane (25 mL) was treated with triethylamine (2.7 mL, 19.37 mmol, 3.1 eq.) in a dropwise fashion. Stirring was continued for 15 hours. The solvent was removed under reduced pressure and the solid obtained was dried in a vacuum desiccator. Thus, the title compound (2.16 g, 98%) was obtained as a white solid. $\delta_H$ (400 MHz, $CDCl_3$) 1.36–1.44 (4H, m, $CH_2$), 1.54–1.65 (4H, m, $CH_2$), 3.26 (4H, q(br), J 6.5 Hz, $CH_2$), 5.05 (2H, m(br), NH), 7.12 (4H, d, J 7.5 Hz, ArH), 7.18 (2H, t, J 7.5 Hz, ArH), 7.34 (4H, t, J 7.5 Hz, ArH); $\delta_C$ (100 MHz, $CDCl_3$) 26.2, 29.7, 41.0 ($CH_2$), 121.6 (CH), 125.2 (C-ipso), 129.2 (CH), 151.1 (C-ipso), 154.6 (CO). Found C, 66.00; H, 7.02; N, 8.27; $C_{20}H_{24}N_2O_4$ requires C, 67.42; H, 6.74; N, 7.87.

Example 9

Synthesis of Hexamethylene Diisocyanate Blocked with Succinimide

Synthesis:

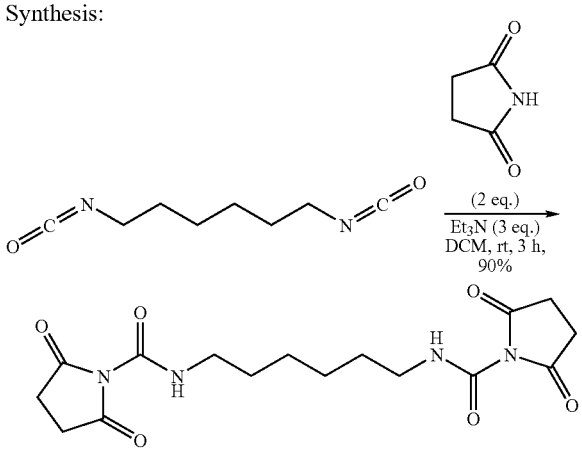

At room temperature a solution of diisocyanatohexane (7.57 g, 45.01 mmol, 1 eq.) and succinimide (8.90 g, 90.01 mmol, 2.0 eq.) in dichloromethane (100 mL) was treated with triethylamine (18.8 mL, 135.0 mmol, 3.0 eq.) in a dropwise fashion. Stirring was continued for 1 hour. The white precipitate formed was collected by filtration and washed with dichloromethane (3×50 mL) and dried in a vacuum desiccator. Thus, the title compound (14.93 g, 90%) was obtained as a white (colourless) powder. $\delta_H$ (270 MHz, $d_6$-DMSO) 1.12–1.45 (8H, m, $CH_2$), 2.64 (8H, s, $CH_2$), 3.01 (4H, q, J 6.5 Hz, $CH_2$), 9.25–9.34 (2H, t, J 6.5 Hz, NH). Found C, 52.28; H, 6.04; N, 15.30; $C_{16}H_{22}N_4O_6$ requires C, 52.46; H, 6.01; N, 15.30.

Example 10

Synthesis of Hexamethylene Diisocyanate Blocked with Sodium Bisulphite

Synthesis:

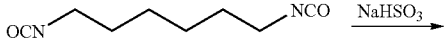

-continued

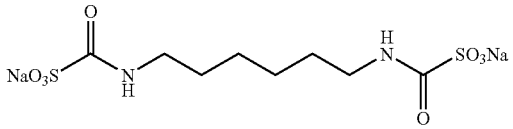

In a 100 mL round-bottom flask containing a magnetic stirrer bar, hexamethylene diisocyanate (6.73 g, 0.04M) was added sodium metabisulphite (8.36 g, 0.044M) dissolved in 16 mL of water and the turbid solution covered and stirred for 17 hours at room temperature (20° C.). The product was precipitated in acetone (100 mL) filtered and dried. The product was dissolved in water (30 mL) then precipitated with acetone (350 mL), filtered and dried in vacuo, resulting in a fine white powder in 93% yield*.

*NMR assay (internal trioxan standard) confirmed a purity of 57.43%. The impurities probably are sodium metabisulphite. $^1$H NMR-($D_2O$): δ (ppm) 1.36 (4H, m); 1.55 (water, s); 1.59 (4H, m); 2.23 (acetone, s); 3.29 (4H, t); 4.74 ($D_2O$); 5.23 (trioxan, 6H, s).

FTIR confirmed the formation of CONH (1680 $cm^{-1}$) and lack of an isocyante peak (2275 $cm^{-1}$) indicated that no free diisocyanate was present.

Example 11

Synthesis of Hexamethylene Diisocyanate Blocked with 4-Nitrophenol

Synthesis:

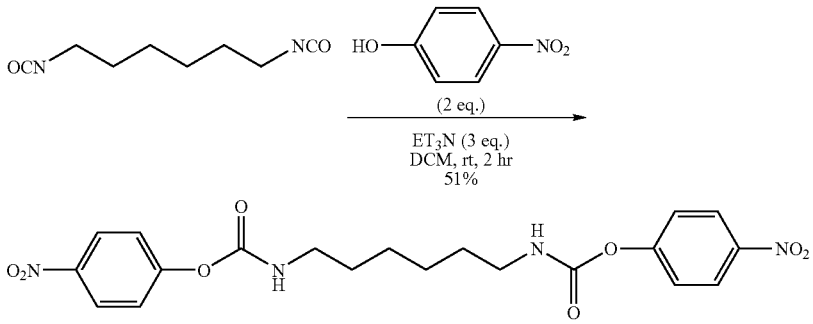

Diisocyanatohexane (4.1 mL, 25.35 mmol, 1 eq.) and 4-nitrophenol (7.06 g, 50.75 mmol, 2.0 eq.) in dichloromethane (100 mL) was treated with triethylamine (7.1 mL, 50.75 mmol, 2.0 eq.) in a dropwise fashion. Stirring was continued for 2 hours. The yellowish precipitate formed was collected by filtration and washed with dichloromethane (2×50 mL), $Et_2O$ (1×50 mL) and dried in a vacuum desiccator. Thus, the title compound (11.25 g, 100%) was obtained as a white-yellow powder. $\delta_H$ (400 MHz, $d_6$-DMSO) 1.31–1.45 (4H, m, $CH_2$), 1.46–1.59 (4H, m, $CH_2$), 3.10 (4H, t(br), J 6.5 Hz, $CH_2$), 7.40 (4H, d, J 9.0 Hz, ArH), (2H, t(br), J 6.5 Hz, NH), 8.28 (4H, d, J 9.0 Hz, ArH). Found C, 52.28; H, 6.04; N, 15.30; $C_{16}H_{22}N_4O_6$ requires C, 52.46; H, 6.01; N, 15.30.

Example 12

Synthesis of Hexamethylene Diisocyanate Blocked with 4-Methoxyphenol

Synthesis:

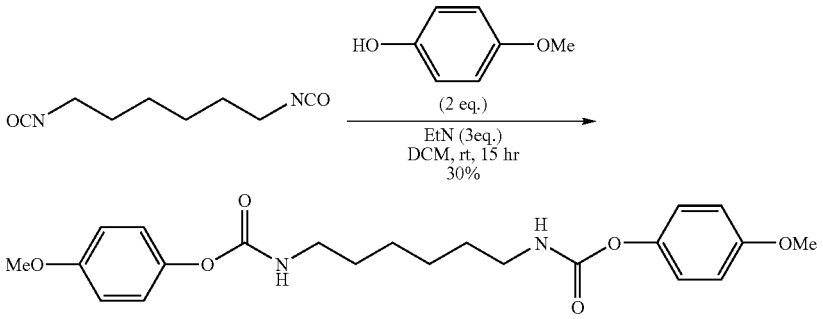

Diisocyanatohexane (3.5 mL, 21.58 mmol, 1 eq.) and 4-methoxyphenol (5.36 g, 43.17 mmol, 2.0 eq.) in dichloromethane (50 mL) was treated with triethylamine (9.0 mL, 64.76 mmol, 3.0 eq.) in a dropwise fashion. Stirring was continued for 15 hours. The white precipitate formed was collected by filtration and washed with dichloromethane (2×50 mL) and dried in a vacuum desiccator. Thus, the title compound (5.0 g, 59%) was obtained as a white powder. $\delta_H$ (400 MHz, $d_6$-DMSO) 1.25–1.42 (4H, m, $CH_2$), 1.45–1.55 (4H, m, $CH_2$), 3.07 (4H, q(br), J 6.0 Hz, $CH_2$), 3.36 (6H, S, $CH_3$), 6.90 (4H, d, J 9.0 Hz, ArH), 7.02 (4H, d, J 9.0 Hz, ArH), 7.61 (2H, t(br), J 6.0 Hz, NH); $\delta_C$ (100 MHz, $d_6$-DMSO) 26.3, 29.5, 40.7 ($CH_2$), 55.7 ($CH_3$), 114.5, 122.9 (CH), 144.9, 155.1 (C-ipso), 156.6 (CO). Found C, 62.58; H, 7.08; N, 7.66; $C_{20}H_{28}N_2O_6$ requires C, 61.22; H, 7.14; N, 7.14.

Example 13

Synthesis of Hexamethylene Diisocyanate Blocked with Methyl Salicylate

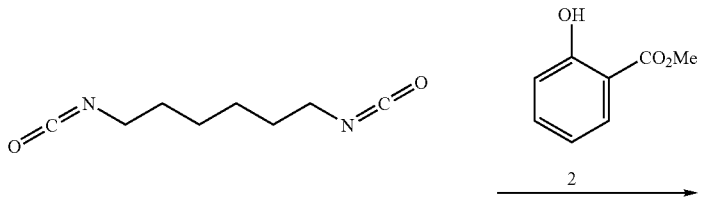

1

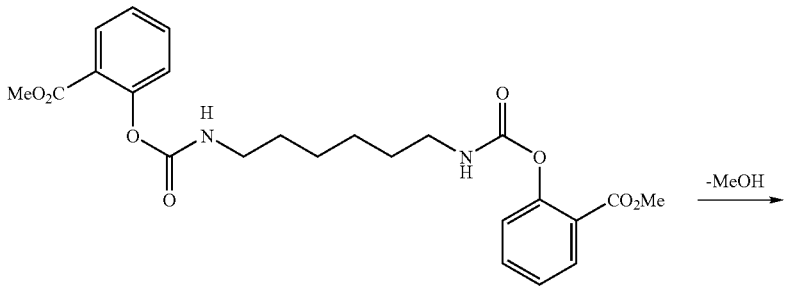

3

-continued

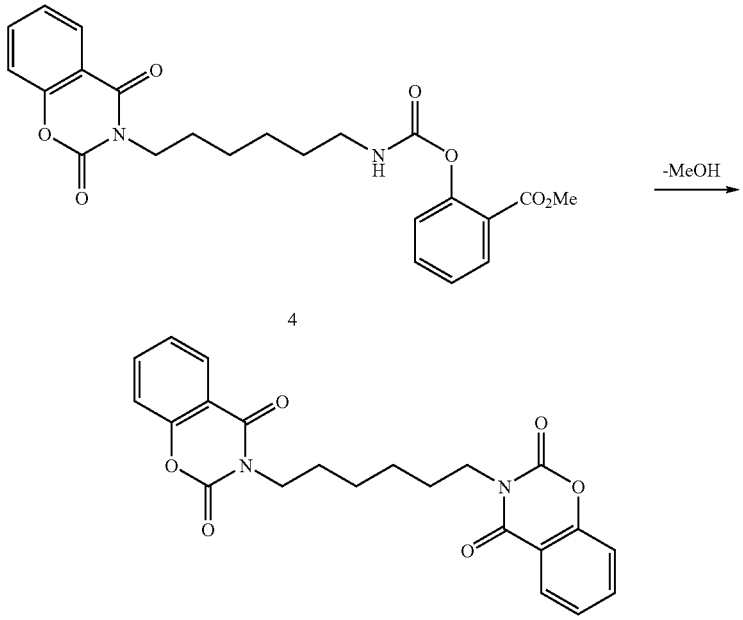

4

5

Diisocyanatohexane 1 (0.9 mL, 5.57 mmol, 1 eq.) and the phenol 2 (1.50 g, 10.38 mmol, 1.9 eq.) in dichloromethane (50 mL) was treated with triethylamine (2.3 mL, 16.69 mmol, 3.0 eq.) in a dropwise fashion. Stirring was continued for 15 hours. The solvent was removed under reduced pressure and the crude reaction mixture was purified by flash column chromatography (Hex-EtOAc; 2:1→1:1) affording the title compound (4) as a white (colourless) crystalline solid (0.725 g, 29%) was obtained as a white powder. $R_f$=0.15 (Hex-EtOAc; 1:1); m/z ($ES^+$) 463 ($MNa^+$, 100%);. $\delta_H$ (250 MHz, $CDCl_3$) 1.32–1.95 (BH, m, $CH_2$), 3.23 (2H, q, J 6.5 Hz, $CH_2$), 3.82 (3H, s, $CH_3$), 4.02 (2H, t, J 7.0 Hz, $CH_2$), 5.29 (1H, m(br), NH), 7.12 (1H, d, J 7.5 Hz, ArH), 7.20–7.34 (3H, m, ArH), 7.51 (1H, dt, J 1.5, 7.5 Hz, ArH), 7.69 (1H, dt, J 1.5, 7.5 Hz, ArH), 7.96 (1H, dd, J 1.5, 7.5 Hz, ArH), 8.08 (1H, dd, J 1.5, 7.5 Hz, ArH). found C, 61.9; H, 5.5; N, 6.2%, $C_{23}H_{24}O_7N_2$ requires C, 62.7; H, 5.45; N, 6.4%.

Application Examples

In the examples 14–19 and 27 given below, the synthesised esters were pad applied to oxford cotton fabric (18×6 cm) at 100% pick-up from solvent (e.g. THF and/or water). The fabric swatches were then dried, followed by an iron cure on high setting (cotton/linen) for the time specified.

After curing, the swatches were conditioned at 20° C., 65% relative humidity then the crease recovery angle (CRA) measured (using BS1553086). A sample of fabric (25 mm×50 mm) was folded in half forming a sharp crease and held under a weight of 1 kg for 1 minute. On releasing the sample the crease opens up to a certain degree. After 1 minute relaxation, time the angle is measured. The fabric is tested in the warp direction only (hence maximum CRA is 180°). Higher CRA therefore indicates less wrinkled fabric.

In examples 19–26 blocked isocyanates were pad applied to cotton fabric (18×6 cm) at 100% pick-up from an appropriate solvent. The fabric swatches were then dried, followed by an iron cure on high setting (cotton/linen) for the time specified.

After curing, the swatches were conditioned at 20° C., 65% relative humidity then the crease recovery angle (CRA) measured (using a modified method based on BS1553086). A sample of fabric (25 mm×50 mm) is folded in half forming a sharp crease and held under a weight of 1 kg for 1 minute. On releasing the sample the crease opens up to a certain degree. After 1 minute relaxation time the angle is measured. The fabric is tested in the warp direction only (hence maximum CRA is 180). Higher CRAs correspond to less wrinkled fabrics.

Example 14

Application of 2,4,6-Trichlorophenol Diester of Butanetetracarboxylic Acid

CRA results obtained with a 5% solution of diester in THF (1 g diester in 19 g THF) are shown in Table 1 below.

TABLE 1

| | CRA | | | |
|---|---|---|---|---|
| | 10 s iron | 20 s iron | 30 s iron | 60 s iron |
| UT Control | 79 | — | — | — |
| 5% Diester | 92 | 99 | 98 | 103 |

From these results it can be seen that less creasing (higher CRA) was obtained with the treated samples than with the untreated samples (UT). It can also be seen that the effect of a longer ironing-time on treated swatches is to further improve the results for the crease test (which occurs after the ironing step).

Example 15

Application of 2,4,5-Trichlorophenol Diester of Succinic Acid

CRA results obtained with a 7.65% solution of diester in THF are given in Table 2 below:

TABLE 2

| | CRA | | | |
|---|---|---|---|---|
| | 10 s iron | 20 s iron | 30 s iron | 60 s iron |
| UT Control | 78 | — | — | — |
| 7.65% Diester | 92 | 99 | 102 | 113 |

From these results it can again be seen that less creasing (higher CRA) was obtained with the treated samples than with the untreated samples (UT), and that a longer curing step further improved the results.

Example 16

Application of N-Hydroxysuccinimide Diester of Succinic Acid

CRA results obtained with a 5.25% solution of diester in THF and water are given in Table 3 below:

TABLE 3

| | CRA | | | |
|---|---|---|---|---|
| | 10 s iron | 20 s iron | 30 s iron | 60 s iron |
| UT Control | 71 | | | |
| 5.25% Diester (THF) | 87 | 88 | 93 | 95 |
| 5.25% Diester (water) | 93 | 95 | 92 | 92 |

From these results it can be seen that less creasing (higher CRA) was obtained with the treated samples (both from THF and water) than with the untreated samples (UT). A water carrier gives good results with both a short and long a short curing/ironing step.

Example 17

Application of Vanillin Diester of Succinic Acid

CRA results obtained with 6.55% Diester in THF (19 $cm^3$) initially, increasing amount of water added are given in Table 4 below:

TABLE 4

| | CRA - 60 s Iron |
|---|---|
| UT Control | 77 |
| 6.55% Diester in THF (no water added) | 82 |
| 6.55% Diester in THF + 1 $cm^3$ $H_2O$ | 86 |
| 6.55% Diester in THF + 2 $cm^3$ $H_2O$ | 85 |
| 6.55% Diester in THF + 3 $cm^3$ $H_2O$ | 88 |
| 6.55% Diester in THF + 5 $cm^3$ $H_2O$ | 91 |

From these results it can be seen that less creasing (higher CRA) was obtained with the treated samples (both from THF and THF+water) than with the untreated samples (UT).

Example 18

Application of 4-Cyanophenol Diester of Succinic Acid

CRA results obtained with a 5.45% solution of diester in THF are given in Table 5 below:

TABLE 5

| | CRA - 60 s Iron |
|---|---|
| UT Control | 77 |
| 5.45% Diester | 84 |

From these results it can be seen that less creasing (higher CRA) was obtained with the treated samples than with the untreated samples (UT).

Example 19

Application of Hexylene Diisocyanate Biuret Blocked with Diethyl Malonate

The structure of this molecule is shown below.

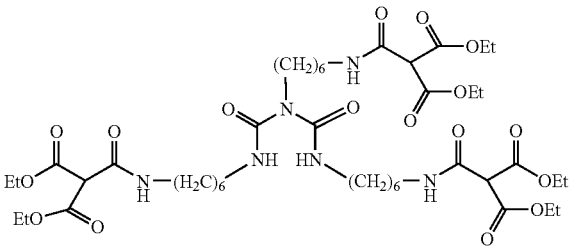

Hexylene diisocyanate biuret blocked with diethyl malonate (trade name BI7963 ex. Baxenden Chemicals Ltd) was obtained as a 70% solution in 1-methoxy-2-propanol and diluted in THF to give a 2% solution. Results are given in table 6 below

TABLE 6

| CRA Results | |
|---|---|
| Ironing Time | CRA |
| UT control | 76 |
| Light iron (less than 2 s) | 90 |
| 2 s | 92 |
| 4 s | 93 |
| 6 s | 92 |
| 8 s | 95 |
| 10 s | 97 |

In the case of the treated samples, it can be seen that even a very brief period of ironing gives a marked improvement in crease recovery. It is believed that this is due to the cross-reaction of the material with cellulose. It is also believed that this is an example of one of the isocyanate reactions which gives a true ester rather than a carbamate on reaction with cellulose.

Example 20

Application of Hexamethylene Diisocyanate Blocked with Meldrum's Acid

Application was as described above from a 2% solution. Results are given in table 6 below. It can be seen that crease recovery angles were improved as compared with the control.

TABLE 6

| CRA (2% solution in DCM) | |
|---|---|
| Ironing Time | CRA |
| UT Control | 73 |
| 2 s | 83 |
| 6 s | 85 |
| 10 s | 84 |
| 20 s | 85 |

Example 21

Application of Hexamethylene Diisocyanate Blocked with Phenol

Application was as described above from a 2% solution. Results are given in table 7 below. It can be seen that crease recovery angles were improved as compared with the control.

TABLE 7

| CRA (2% solution in THF) | |
|---|---|
| Ironing Time | CRA |
| UT Control | 73 |
| 2 s | 84 |
| 6 s | 94 |
| 10 s | 89 |
| 20 s | 89 |

Example 22

Application of Hexamethylene Diisocyanate Blocked with Succinimide

Application was as described above from a 2% solution. Results are given in table 8 below. It can be seen that crease recovery angles were improved as compared with the control.

TABLE 8

| CRA (2% solution in DMAc) | |
|---|---|
| Ironing Time | CRA |
| UT Control | 73 |
| 2 s | 94 |
| 6 s | 98 |
| 10 s | 99 |
| 20 s | 102 |

Example 23

Application of Hexamethylene Diisocyanate Blocked with Sodium Bisulphite

Application was as described above from a 1% solution. Results are given in table 9 below. It can be seen that crease recovery angles were improved as compared with the control.

TABLE 9

| CRA (1% solution in water) | |
|---|---|
| Ironing Time | CRA |
| UT Control | 75 |
| 2 s | 78 |
| 6 s | 83 |
| 10 s | 85 |
| 20 s | 85 |

Example 24

Application of Hexamethylene Diisocyanate Blocked with 4-Nitrophenol

Application was as described above from a 2% solution. Results are given in table 10 below. It can be seen that crease recovery angles were improved as compared with the control.

TABLE 10

| CRA (2% solution in DMAc) | |
|---|---|
| Ironing Time | CRA |
| UT Control | 73 |
| 2 s | 77 |
| 6 s | 83 |
| 10 s | 95 |
| 20 s | 92 |

Example 25

Application of Hexamethylene Diisocyanate Blocked with 4-Methoxyphenol

Application was as described above from a 2% solution. Results are given in table 11 below. It can be seen that, other than for very short ironing times, crease recovery angles were improved as compared with the control.

TABLE 11

| CRA (2% solution in DMAc) | |
|---|---|
| Ironing Time | CRA |
| UT Control | 73 |
| 2 s | 73 |
| 6 s | 73 |
| 10 s | 84 |
| 20 s | 90 |

Example 26

Application of Hexamethylene Diisocyanate Blocked with Methyl Salyciliate

Application was as described above from a 2% solution. Results are given in table 12 below. It can be seen that crease recovery angles were improved as compared with the control.

TABLE 12

| CRA (2% solution in THF) | |
|---|---|
| Ironing Time | CRA |
| UT Control | 73 |
| 2 s | 87 |
| 6 s | 86 |
| 10 s | 87 |
| 20 s | 86 |

Example 27

Application of Isoeuginol Diester of Succinic Acid

Upon application of the isoeuginol diester to cotton and subsequent ironing, a clove fragrance was released as the trans-esterification crosslinking occurred.

The invention claimed is:

1. A method of treating finished garments comprising cellulosic material so as to cause cross-linking, which comprises the step of treating fabrics with an effective amount of a blocked cross-linking agent for cellulose, said cross-linking agent being thermally activated, wherein the blocked cross-linking agent comprises a polycarboxylic acid, which is blocked by esterification with an electron withdrawing alcohol or imide to form a polyester and wherein the blocking alcohol or imide comprises one or more of:

a) trichlorophenol,
b) isoeuginol,
c) menthol,
d) 4-cyanophenol,
e) ethyl salicylate,
f) 2,6-dimethoxy phenol,
g) 4-aminophenol,
h) dimethylamino phenol, and,
i) N-hydroxysuccinimide.

2. A method according to claim 1 wherein the polycarboxylic acid is succinic acid, butyl tetra carboxylic acid (BTCA), 3,6-dioxaoctanedioic acid, tartaric acid, mucic acid, glutamic acid, methylamino diacetic acid, or nitriloacetic acid.

3. A method according to claim 1 wherein the polyester comprises one or more of:

a) trichlorophenol diester of succinic acid,
b) trichlorophenol diester of BTCA,
c) N-hydroxysuccinimide diester of succinic acid,
d) isoeugenol diester of succinic acid, and,
e) menthol diester of succinic acid.

4. A method according to claim 1 which further comprises the step of heat curing the cellulosic material.

5. A method according to claim 4 wherein heat treatment is performed at a temperature of from 50 to 250° C., more preferably at a temperature of from 100–200° C.

6. A method accord to claim 1 wherein the cross-linking agent has a molecular weight below 1500 Dalton.

* * * * *